United States Patent [19]

Benson

[11] 4,372,481

[45] Feb. 8, 1983

[54] MAILBOX MARKING ATTACHMENT

[76] Inventor: Ronald K. Benson, Rte. #2, Montague, Mich. 49437

[21] Appl. No.: 96,903

[22] Filed: Nov. 23, 1979

[51] Int. Cl.[3] ..... B65B 91/00

[52] U.S. Cl. ..... 232/34; 248/231; 248/539

[58] Field of Search ..... 232/17, 35, 39, 34; 24/274, 278; 248/231, 222.1, 225.3 R, 539, 534

[56] References Cited

U.S. PATENT DOCUMENTS

| | | | |
|---|---|---|---|
| 1,281,062 | 10/1918 | Norvell | 232/39 UX |
| 1,296,866 | 3/1919 | Skretting | 248/539 |
| 2,433,940 | 1/1948 | Weaver | 232/35 |
| 2,672,693 | 3/1954 | Cannel | 248/231 X |
| 2,859,913 | 11/1958 | Paschke et al. | 232/35 |
| 3,490,411 | 1/1970 | Poindexter | 232/35 |
| 3,596,631 | 8/1971 | Sutton | 232/35 X |
| 3,647,171 | 3/1972 | Rafferty | 248/231 X |
| 3,683,842 | 8/1972 | Logan | 248/539 X |
| 3,762,632 | 10/1973 | Voegeli | 248/231 X |
| 3,794,240 | 2/1974 | Myers | 232/35 |
| 3,968,928 | 7/1976 | Caldwell | 232/35 |
| 3,984,076 | 10/1976 | Van Ordt | 248/539 |
| 4,190,193 | 2/1980 | Smith | 232/35 |

*Primary Examiner*—Roy D. Frazier
*Assistant Examiner*—Peter A. Aschenbrenner
*Attorney, Agent, or Firm*—Waters, Lesniak & Willey

[57] ABSTRACT

An auxiliary mailbox marking attachment comprises a mounting strap transversely surrounding, and generally conforming to the shape of, the exterior top and sides of a mailbox. A portion of the mounting strap extends inwardly beneath the mailbox such that the mounting strap may be drawn tight to clamp around the exterior of the mailbox. A flag or other marking device is mounted on the mounting strap by a support attached to the mounting strap and serves as a visible indication of the presence of the mailbox.

3 Claims, 7 Drawing Figures

MAILBOX MARKING ATTACHMENT

BACKGROUND OF THE INVENTION

1. Field of the Invention

The present invention relates to an auxiliary mailbox marking attachment designed for clamping around a mailbox with a member supporting a visible marking device that marks the location of a mailbox that is otherwise obstructed from view.

2. Description of the Prior Art

Mailbox marking devices employed in the past have included spring-loaded flags designed to indicate that the box has been opened and thus informing the user that mail has been delivered to the box that day. Other marking devices have been employed which comprise a pivotal flag which may be raised to indicate to a postman that the box contains outgoing mail to be picked up by him. Another device designed to be attached to mailboxes includes a flag-mounting attachment designed for convenient mounting of a small United States or state flag on holidays and other appropriate occasions. One disadvantage with the above mailbox marking devices is that the marking devices are not visible at all times and the mailbox can be blocked from view by obstructions such as highly piled snow along the road in the winter.

One of the objectives of the present invention is to provide a highly visible mailbox device which may be readily clamped to a mailbox without the necessity of modifying or drilling holes in the mailbox to accommodate the marking device. A further objective is to provide such a marking device that may be quickly and conveniently removed during the summer or at other times when a highly visible indication of the presence of the mailbox is not needed. Still another objective of the present invention is to provide the mailbox marking attachment that is easily visible when the mailbox is otherwise obstructed.

SUMMARY OF THE INVENTION

In accordance with the present invention, an auxiliary mailbox marking attachment is designed for clamping to conventional mailboxes found in many rural areas. The present invention comprises a mounting member that transversely fits over the exterior top and sides of a mailbox, with a lower portion of the mounting member extending inwardly at least partially beneath the mailbox. A tightening mechanism draws the mounting member snugly against the mailbox, and a visible marking device attached to the mounting member indicates the presence of the mailbox.

In one embodiment of the present invention, the mounting member comprises a steel strap that fits over the top of the mailbox and hooks under the side edges of the mailbox, with a threaded portion in the top of the strap designed to receive a tightening bolt. When the bolt is screwed into the threaded portion of the strap, it extends downwardly and presses against the top of the mailbox, thus drawing the mounting strap tight against the mailbox.

Attached to the side of the mounting strap is a bracket which supports a flag pole with a brightly colored, highly visible flag at the upper end of the pole. The flag pole has movable reflectors mounted at one or more positions along its length, thus facilitating visibility of the marking device at night. A segment of the pole is removed and replaced by a spring member that allows the pole to return to its original upright position after being bent over and released.

In another embodiment of the present invention, the mounting member comprises a steel strap fabricated in a generally U-shaped configuration. Lower ends of the strap are angled inwardly for clamping along lipped lower edges of the sides of the mailbox. The strap is formed in two segments, which are connected by means of a threaded screw rotatably mounted parallel to the strap at one end of one of the segments. The threads of the screw engage a plurality of spaced slots cut into the surface of the other strap segment such that when rotated, the screw threads engage the slots in succession, as they would threads in a bolt. As the screw is tightened, the segments of the mounting strap move longitudinally with respect to each other so as to decrease the overall length of the U-shaped strap. Thus, when the screw is tightened, while the strap's angled ends are engaging the bottom of the mailbox, the strap draws snugly against, and is mounted firmly upon, the exterior of the mailbox.

In still another embodiment of the present invention, the mounting strap comprises two separate segments. A top segment is fabricated in a configuration to surround, and generally conform in shape to, the upper portion of the mailbox. The free ends of the upper segment of the strap are angled outwardly and horizontally to form tabs with vertical holes in them. The lower segment of the mounting member is a strap fabricated in a configuration such that it extends under the bottom of the mailbox, with its free ends culminating in tabs having vertical holes and designed to flatly engage the tabs of the upper segment of the mounting strap. The two segments of the mounting member are bolted together to tightly clamp upon, and transversely encircle the entire mailbox. A mounting bracket designed to support the indicating flag described above is rigidly attached to one side of the upper segment of the mounting member.

DETAILED DESCRIPTION OF PREFERRED EMBODIMENTS

Figure 1:
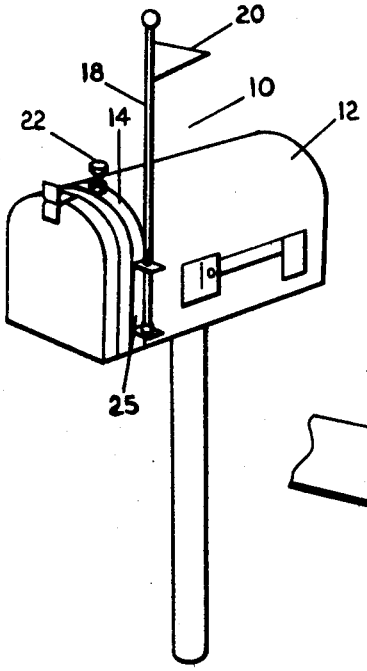
FIG. 1 is a perspective view of the present invention attached on a typical mailbox.

Referring to the drawings, in FIG. 1 the present invention generally designated as 10 is shown attached to a typical mailbox 12. A mounting member 14 transversely surrounds, and generally conforms to the shape of, the exterior top and sides of mailbox 12. Flagpole holder 25 holds a flagpole 18 upon which a flag 20 is mounted. Mounting member 14 is held tight against mailbox 12 by means of a tightening bolt 22 being tightened against the top of mailbox 12.

Figure 2:
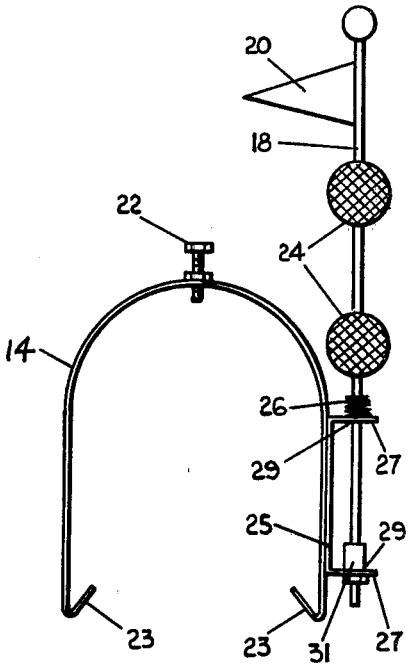
FIG. 2 is a perspective view of one embodiment of the present invention having a bolt tightening means extending through a threaded portion of the mounting member for drawing the mounting member tight against the mailbox.

In FIG. 2, the embodiment of the present invention of FIG. 1 is shown removed from the mail receptacle. Mounting member 14 is a generally U-shaped strap formed of resilient metal or plastic or the like, with its free ends 23 being angled upward to engage the lower lip of a mailbox (not shown). Flagpole holder 25, on the side of mounting member 14, receives flagpole 18 upon which is mounted a visible indicator 20 in the form of a flag or the like. Movable reflectors 24 are slideably, and rotatably, mounted on flagpole 18 so that their orientation and position along flagpole 18 may be varied as desired. Flagpole holder 25 is a generally flat strap-shaped member with ends 27 bent at a perpendicular angle having holes in the ends to receive flagpole 18. Flagpole holder 25 is welded or soldered to mounting member 14, or alternatively attached by means of conventional fasteners such as rivets (not shown). Flagpole 18 is mounted on flagpole holder 25 by means of flagpole connector 31 which is shown and described in more detail in FIG. 3. Finally, flagpole 18 has a segment removed and replaced by spring member 26, desirably a bendable coil spring, which allows flagpole 18 to return to its upright position after being bent over and released.

Figure 3:
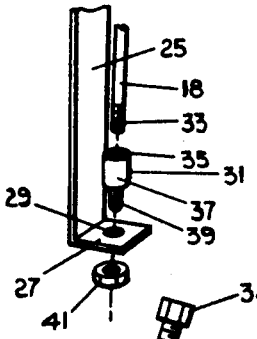
FIG. 3 is an exploded view of the flagpole mounting components.

In FIG. 3, flagpole connector 31 is illustrated in an exploded view with its related components. Flagpole 18 has a threaded end 33 that fits into the threaded hole 35 on shank 37 of flagpole connector 31. The threaded portion 39 of flagpole connector 31 fits through hole 29 on end 27 of flagpole holder 25 and is secured by nut 41.

Figure 4:
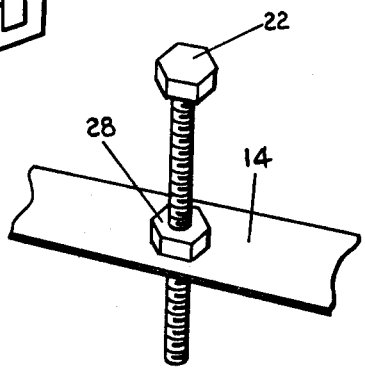
FIG. 4 is a broken perspective view showing the rightening means of FIG. 2 in detail.

In FIG. 4, tightening bolt 22 is shown extending through a threaded nut 28 rigidly mounted on mounting member 14.

Figure 5:
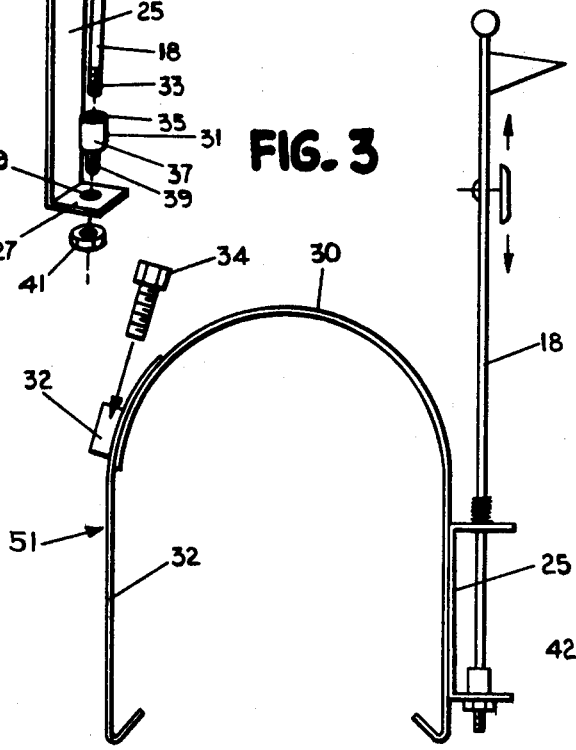
FIG. 5 is a front elevational view of another embodiment of the present invention wherein the mounting member is formed in two segments which are urged to move with respect to each other in response to the turning of a tightening screw.

In FIG. 5, another embodiment of the present invention is shown. This includes a mounting member 51 having hooked lower ends 33 that are attached to the mailbox in the same manner as the previous described embodiment. Mounting member 51 comprises an upper segment 30 attached to a lower segment 32 by means of tightening screw 34, which extends through a threaded housing 36 that is rigidly attached to upper segment 30. As tightening screw 34 is turned, lower segment 32 moves longitudinally with respect to upper segment 30 to tighten or loosen the mounting member. Upper segment 30 has flagpole holder 25 rigidly attached to its side for receiving flagpole 18.

Figure 6:
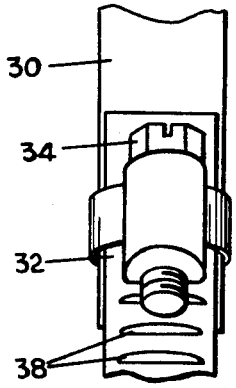
FIG. 6 is a broken view showing in detail the tightening screw of FIG. 4.

In FIG. 6, a detail of the tightening mechanism of the embodiment of the present invention of FIG. 4 is shown. Tightening screw 34 extends through housing 36 on upper segment 30. The threads of tightening screw 34 also engage a plurality of spaced slots 38 in lower segment 32 in succession so that as tightening screw 34 is turned lower segment 32 moves longitudinally with respect to upper segment 30.

Figure 7:
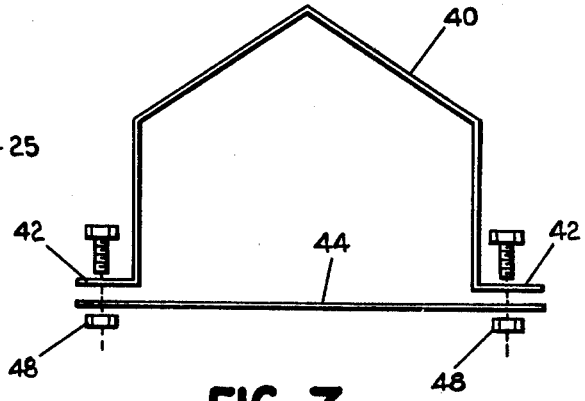
FIG. 7 is a front elevational view showing still another alternate embodiment of the present invention having an upper and lower segment bolted together at their ends.

In FIG. 7, still another embodiment of the present invention is shown. In this embodiment, mounting member 39 comprises an upper segment 40 shaped to transversely surround, and generally conform to, the exterior top and sides of a mailbox having a peaked roof and straight sides (not shown). At each lower end of upper segment 40 are mounting tabs 42 which are angled outwardly in a horizontal direction and have vertical holes. Mounting member lower segment 44 extends horizontally across the bottom of the mail receptacle (not shown), with its free ends flatly engaging mounting tabs 42. Upper segment 40 and lower segment 44 are fastened to each other by means of bolts 46 extending through mounting tabs 42 and the ends of lower segment 44 and through tightening nuts 48.

It should be understood that the foregoing represent merely exemplary embodiments of the present invention and that various changes and modifications may be made in the arrangements and details of construction of the elements described and shown above without departing from the spirit and scope of the present invention.

The embodiments of the invention in which an exclusive property or privilege is claimed are defined as follows:

1. An auxiliary mailbox marking attaching for attachment to a mail receptacle having a top, sides, and a bottom, the mailbox marking attachment comprising:

a mounting member that fits transversely over the exterior top and sides of the mail receptacle, with a lower portion of the mounting member extending inwardly at least partially beneath the mail receptacle, the mounting member comprising a strap device that fits over and generally conforms in shape to the exterior of the mail receptacle, the strap having inwardly angled lower ends that fit under lower edges of the mail receptacle;

tightening means for tightening the strap device so it is held tightly in position on the mail receptacle;

flagpole mounting means attached to the side of the strap device for releasably attaching a flagpole to the mailbox, the flagpole mounting means comprising a bracket having a back attached to the strap and vertically spaced upper and lower tabs extending outwardly from upper and lower ends of the back, respectively, the tabs having aligned vertical openings therein; and a flagpole releasably mounted in the flagpole mounting means, the flagpole extending downwardly through the opening in the upper tab and being releasably attached to a connector that is in turn releasably fixed to the lower tab by means of a threaded fastener that extends through the opening in the lower tab, the flagpole having a removed section therein above the upper tab, with a spring connecting the portions of the flagpole on each side of the removed section, the spring permitting the portion of the flagpole above the spring to be resiliently deflected downwardly with respect to the portion of the flagpole below the spring, the lower portion of the flagpole being held in a fixed position by the flagpole mounting means.

2. An auxiliary mailbox marking attachment according to claim 1 wherein the strap is formed of a single piece and has lower ends that hook under the lower edges of the mailbox, the tightening means comprising an opening in the top of the strap, a threaded nut mounted in mating position on the opening, and a threaded fastener that engages the nut, rotation of the fastener causing vertical axial movement of the fastener with respect to the nut, downward movement of the fastener causing the lower end thereof to press against the top of the mailbox, thus causing the strap to be raised so that the lower ends thereof snugly engage the lower edges of the mailbox.

3. An auxiliary mailbox marking attachment according to claim 2 wherein at least one reflector and one flag are mounted on the flagpole, with the reflector being pivotable about the pole and slidable along the pole to change the position thereof.

* * * * *